US008157013B1

(12) United States Patent
Trent

(10) Patent No.: US 8,157,013 B1
(45) Date of Patent: Apr. 17, 2012

(54) TENSIONER SYSTEM WITH RECOIL CONTROLS

(75) Inventor: David Trent, Cypress, TX (US)

(73) Assignee: Drilling Technological Innovations, LLC, Houston, TX (US)

( * ) Notice: Subject to any disclaimer, the term of this patent is extended or adjusted under 35 U.S.C. 154(b) by 0 days.

(21) Appl. No.: 12/975,132

(22) Filed: Dec. 21, 2010

Related U.S. Application Data

(60) Provisional application No. 61/420,974, filed on Dec. 8, 2010.

(51) Int. Cl.
*E21B 17/01* (2006.01)

(52) U.S. Cl. ..... 166/355; 166/345; 166/367; 405/224.4

(58) Field of Classification Search ..... 166/355, 166/339, 340, 344, 345, 350–352, 359, 367; 405/223.1, 224.2–224.4
See application file for complete search history.

(56) References Cited

U.S. PATENT DOCUMENTS 4,004,532 A * 1/1977 Reynolds ..... 114/256
4,176,722 A * 12/1979 Wetmore et al. ..... 175/7
4,351,261 A * 9/1982 Shanks ..... 114/264
4,367,981 A * 1/1983 Shapiro ..... 405/224.2
4,449,854 A * 5/1984 Nayler ..... 405/195.1
4,487,150 A * 12/1984 Shanks ..... 114/264
4,756,267 A * 7/1988 Carr et al. ..... 114/230.2
4,759,256 A * 7/1988 Kovit et al. ..... 91/29
4,883,387 A * 11/1989 Myers et al. ..... 405/224.4
5,252,004 A * 10/1993 Butler et al. ..... 405/211
5,846,028 A * 12/1998 Thory ..... 405/195.1
6,585,455 B1 * 7/2003 Petersen et al. ..... 405/224.4
6,817,422 B2 * 11/2004 Jordan ..... 166/381
6,834,723 B2 * 12/2004 Jordan ..... 166/355
6,929,071 B2 * 8/2005 Moncus et al. ..... 166/355
6,968,900 B2 * 11/2005 Williams et al. ..... 166/355
7,008,340 B2 * 3/2006 Williams et al. ..... 474/101
7,112,011 B2 * 9/2006 McCarty et al. ..... 405/224.4
7,131,496 B2 * 11/2006 Williams et al. ..... 166/355
7,131,922 B2 * 11/2006 Williams et al. ..... 474/101
7,191,837 B2 * 3/2007 Coles ..... 166/355
7,231,981 B2 * 6/2007 Moe et al. ..... 166/355
7,270,071 B1 * 9/2007 Shivers et al. ..... 114/265
7,329,070 B1 * 2/2008 Trent et al. ..... 405/224.4
7,588,393 B1 * 9/2009 Shivers et al. ..... 405/224.4
7,654,327 B1 * 2/2010 Shivers et al. ..... 166/345
7,819,195 B2 * 10/2010 Ellis ..... 166/355
7,823,646 B2 * 11/2010 Ellis et al. ..... 166/355
7,886,828 B1 * 2/2011 Shivers et al. ..... 166/355
7,934,561 B2 * 5/2011 Ormond ..... 166/355

(Continued)

*Primary Examiner* — Thomas Beach
*Assistant Examiner* — Matthew Buck
(74) *Attorney, Agent, or Firm* — Buskop Law Group, PC.; Wendy Buskop

(57) ABSTRACT

A tensioner system for an offshore drilling rig for drilling a well with recoil controls is disclosed herein. The tensioner system can include removable independently operable riser tensioner assemblies. Each removable independently operable riser tensioner assembly can include a bidirectional riser recoil valve and a hydraulic cylinder connected thereto. The hydraulic cylinder can power a rod engaged with a clevis and a blind end clevis. The clevis can engage a tension ring on a drilling riser. A fluid containment storage can be connected to the bidirectional riser recoil valve and the hydraulic cylinder, and can have a goose neck for connecting to a flexible jumper. A controller can be connected to the bidirectional riser recoil valve for regulating flow of hydraulic fluid therethrough to control a disconnect process of the drilling riser by controlled raising or lowering of the drilling riser.

17 Claims, 3 Drawing Sheets

U.S. PATENT DOCUMENTS

| | | | | |
|---|---|---|---|---|
| 7,976,247 | B1 * | 7/2011 | Trent et al. | 405/224.4 |
| 7,980,786 | B1 * | 7/2011 | Trent et al. | 405/224.4 |
| 7,980,787 | B1 * | 7/2011 | Trent et al. | 405/224.4 |
| 2008/0031692 | A1 * | 2/2008 | Wybro et al. | 405/224.4 |
| 2008/0304916 | A1 * | 12/2008 | Crotwell et al. | 405/224.2 |
| 2010/0047024 | A1 * | 2/2010 | Curtiss, III | 405/224.4 |
| 2011/0155388 | A1 * | 6/2011 | Haugland | 166/367 |

* cited by examiner

TENSIONER SYSTEM WITH RECOIL CONTROLS

CROSS REFERENCE TO RELATED APPLICATIONS

The present application claims priority to and benefit of U.S. Provisional Patent Application Ser. No. 61/420,974, filed on Dec. 8, 2010, entitled "TENSIONER SYSTEM WITH RECOIL CONTROLS". This reference is incorporated herein in its entirety.

FIELD

The present embodiments generally relate to a tensioner system with recoil controls.

BACKGROUND

A need exists for a tensioner system made from at least one pair of tensioner assemblies to provide a direct acting riser tensioner system with reduced frictional losses as fluid moves through hoses.

A further need exists for a tensioner system that provides controls at a location on a hydraulic cylinder or a fluid containment storage.

A need exists for a tensioner system having a fluid containment storage attached to a hydraulic cylinder with an integrated riser recoil system in direct communication between the fluid containment storage and the hydraulic cylinder.

The present embodiments meet these needs.

BRIEF DESCRIPTION OF THE DRAWINGS

The detailed description will be better understood in conjunction with the accompanying drawings as follows.

Figure 1A:
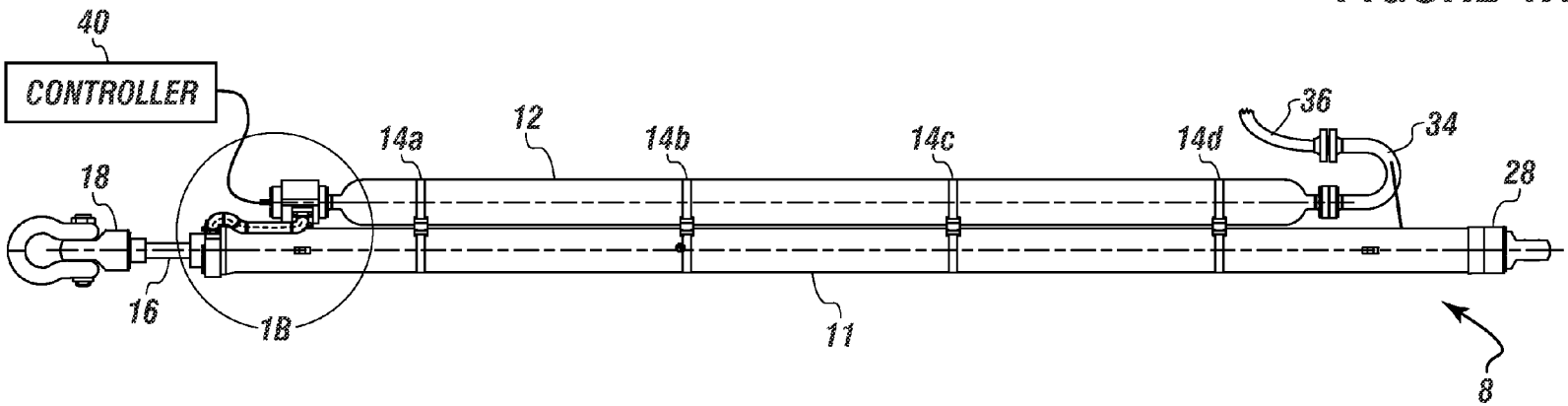
FIGS. 1A-1B depict a side view of a removable independently operable riser tensioner assembly.

The present embodiments are detailed below with reference to the listed Figures.

DETAILED DESCRIPTION OF THE EMBODIMENTS

Before explaining the present system and apparatus in detail, it is to be understood that the system and apparatus are not limited to the particular embodiments and that they can be practiced or carried out in various ways.

The present embodiments relate to a tensioner system for an offshore drilling rig for drilling wells, such as natural gas wells, oil wells, or water wells.

The tensioner system can be a direct acting riser tensioner system. The tensioner system can have a fluid storage containment, such as an accumulator, connected directly to a hydraulic cylinder of the tensioner system. A riser recoil valve can be connected between the fluid storage containment and the hydraulic cylinder. As such, the hydraulic fluid is not required to flow long distances from the hydraulic cylinder to the riser recoil valve, thereby reducing frictional losses that can occur as fluid moves through hoses. The frictional losses can lead to increases and decreases in tension applied by the tensioner system, therefore the present system can provide more accurate and precise tensions, and impart less fatigue stresses on the tensioner system. In one or more embodiments, the frictional loss can be reduced in excess of 200,000 lbf per hydraulic cylinder of the system as compared to conventional systems that include hydraulic fluid movement from the tensioner cylinders to the rig, the riser recoil valve and controller.

The tensioner system can be made from a plurality of tensioner assemblies, each having its own independently operable recoil control.

Each tensioner assembly can have recoil controls at the location of a hydraulic cylinder and a fluid containment storage rather than several yards away from the hydraulic cylinder and the fluid containment storage.

One or more embodiments of the tensioner system can include from two removable independently operable riser tensioner assemblies to twelve removable independently operable riser tensioner assemblies on a trip saver for connecting to the offshore drilling rig.

Each riser tensioner assembly can have a bidirectional riser recoil valve, such as those made by Drilling Technologies Innovations, LLC of Houston, Tex. The bidirectional riser recoil valve can be configured to regulate a flow of hydraulic fluid between an accumulator and a hydraulic cylinder.

Each riser tensioner assembly can include a hydraulic cylinder. The hydraulic cylinder can have a foot stroke ranging from about fifteen feet to about sixty-five feet.

The hydraulic cylinder can be connected to or otherwise in fluid communication with the bidirectional riser recoil valve. In one or more embodiments, the bidirectional riser recoil valve can be connected to the hydraulic cylinder with piping, which can be steel piping, flexible conduit, or any other fluid communication means.

The hydraulic cylinder can power a rod. The rod can be hollow or solid. The rod can engage a clevis on a first end. The hydraulic cylinder can be configured to engage a tension ring on a drilling riser for applying a tension to the drilling riser. The clevis can be configured to engage a tension ring on a drilling riser. The hydraulic cylinder can engage a blind end clevis opposite the clevis.

The rod can have a rod end seal head for flowing hydraulic fluid bidirectionally through the bidirectional riser recoil valve in and out of the fluid containment storage.

Each riser tensioner assembly can include a fluid storage, also referred to as a fluid containment storage, which can be connected to or otherwise in fluid communication with the bidirectional riser recoil valve opposite the hydraulic cylinder. The fluid containment storage can include a goose neck for connecting to a flexible jumper. The hydraulic cylinder and the fluid containment storage can be connected together. For example, the fluid containment storage can be disposed on the hydraulic cylinder and connected thereto, and can be in fluid communication with a jumper. In one or more embodiments, the hydraulic cylinder and the fluid containment storage can be connected using straps, hard stops, one or more saddles, such as a plurality of saddles, or another connection means. In one or more embodiments, the fluid containment storage can be connected directly to the hydraulic cylinder with the bidirectional riser recoil valve connected between the fluid containment storage and the hydraulic cylinder.

In one or more embodiments, the bidirectional riser recoil valve can be connected to the accumulator by bolting, welding, threading, another mechanical connection, or combinations thereof.

The system can have an inlet velocity, an inlet pressure, and an outlet pressure. The system can maintain a high outlet pressure; as such appropriate flow rates can be maintained.

The change in pressure of the system from inlet to outlet can be considerably less than conventional systems, such as up to about ninety percent reduced change in psi than conventional systems. For example, if a conventional tensioner system operates with a change in pressure of 1,035 psi from inlet to outlet, embodiments of the present system can operate with a change in pressure of only 84 psi from inlet to outlet, thereby producing a safer and more durable system for drillers and operators. As such, embodiments of the present system can reduce or eliminate leakage of fluids into surrounding environments, such as the ocean or other waterways.

Each riser tensioner assembly can include a controller that can be connected to or otherwise in communication with the bidirectional riser recoil valve. The controller can be in communication with the bidirectional riser recoil valve. The controller can be configured and used to control and/or regulate flow of hydraulic fluid through the bidirectional riser recoil valve, thereby controlling a disconnect process of the drilling riser by controlling raising and/or lowering of the drilling riser.

The controller can include a microprocessor with memory, which can be in communication with a network, such as the internet, and can provide for continuous, 24 hours a day, 7 days a week status reports on the change in pressure and the operation of the tensioner system.

In operation, the controller of the tensioner system can be used to control the bidirectional riser recoil valve to regulate flow of hydraulic fluid to or from the hydraulic cylinder. As such, the controller can be used in a riser disconnect process of the drilling rig to raise or lower the drilling riser using the tensioner system, thereby providing recoil control.

Figure 1B:
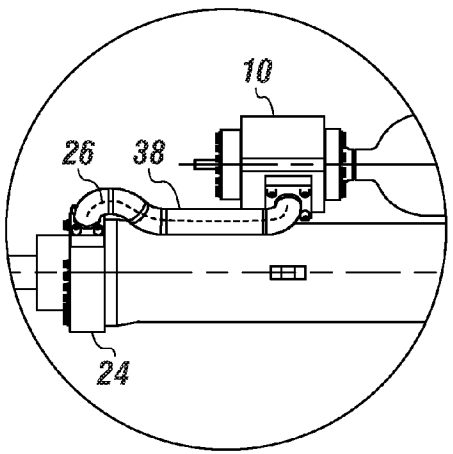

FIG. 1A depicts a side view of a portion of a tensioner system including a removable independently operable riser tensioner assembly 8. FIG. 1B depicts an exploded view of a portion of FIG. 1A.

Referring now to both FIGS. 1A and 1B, the removable independently operable riser tensioner assembly 8 can have a hydraulic cylinder 11 with a rod 16. The rod 16 can be connected to a clevis 18. The rod 16 can also pass into the hydraulic cylinder 11, and be connected to a piston therein. The piston can be in a sliding engagement within the hydraulic cylinder 11, allowing the rod 16 to move along with the piston. The hydraulic cylinder 11 can be connected to a blind end clevis 28. The rod 16 can have a rod end seal head 24.

The hydraulic cylinder 11 can be connected to or in fluid communication with a bidirectional riser recoil valve 10, such as through piping 38, which can be flexible or rigid. The bidirectional riser recoil valve 10 can be connected to or in fluid communication with a fluid containment storage 12.

A plurality of saddles, shown here as a first saddle 14*a*, a second saddle 14*b*, a third saddle 14*c*, and a fourth saddle 14*d*, can connect the fluid containment storage 12 to the hydraulic cylinder 11.

The fluid containment storage 12 can have a goose neck 34 that can be connected to or otherwise in fluid communication with a flexible jumper 36.

A controller 40 can be connected to or otherwise in communication with the bidirectional riser recoil valve 10 for regulating flow of hydraulic fluid 26 through the bidirectional riser recoil valve 10 to control a disconnect process of the drilling riser supported by the offshore drilling rig by controlled raising or lowering of the drilling riser.

Figure 2:
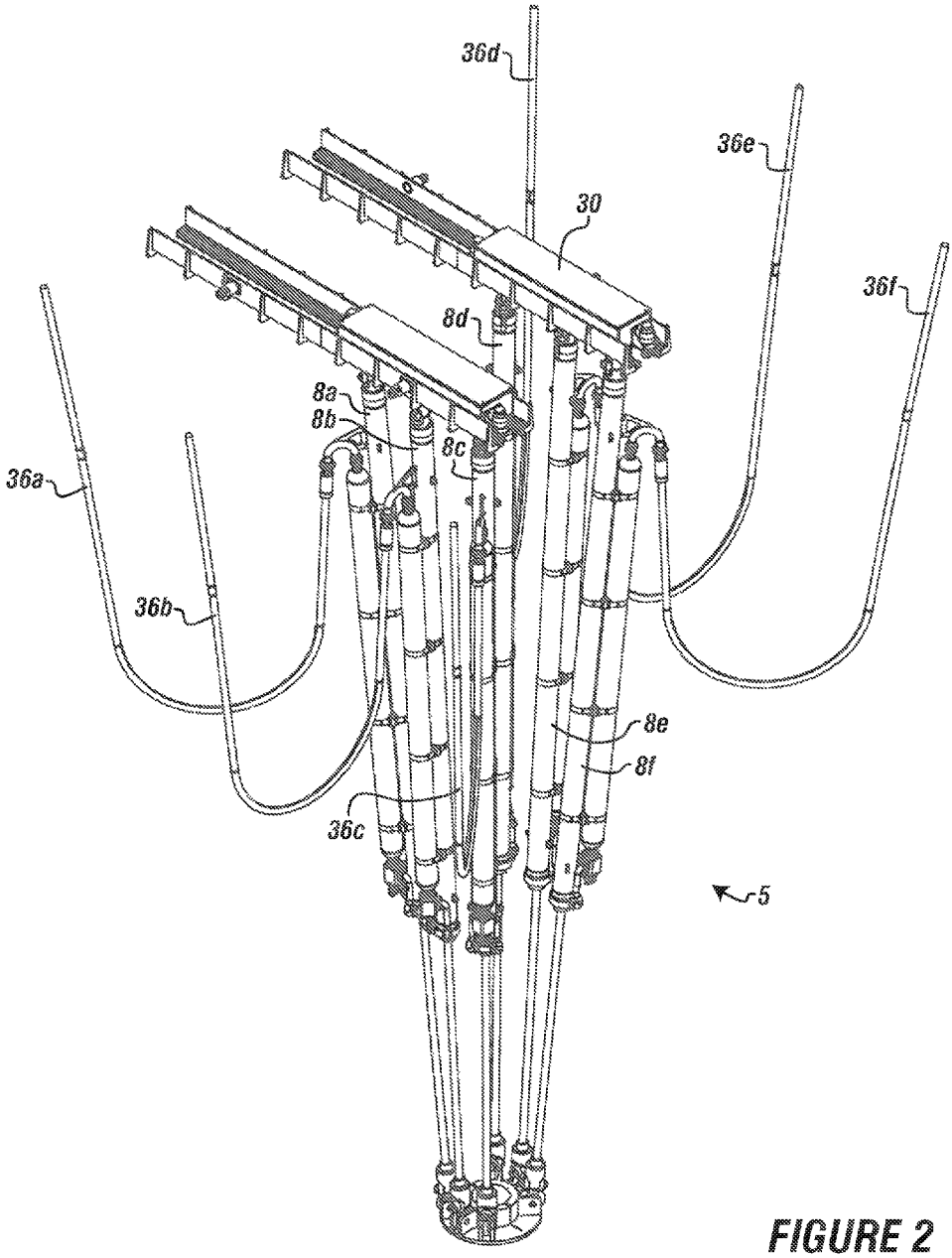
FIG. 2 depicts a tensioner system with a plurality of independently operable riser tensioner assemblies connected to a trip saver of a drilling rig.

FIG. 2 depicts a tensioner system 5 with a plurality of independently operable riser tensioner assemblies, including independently operable riser tensioner assembly 8*a*, independently operable riser tensioner assembly 8*b*, independently operable riser tensioner assembly 8*c*, independently operable riser tensioner assembly 8*d*, independently operable riser tensioner assembly 8*e*, and independently operable riser tensioner assembly 8*f*.

Each of the plurality of independently operable riser tensioner assemblies 8*a*-8*f* can be connected to a trip saver 30. Also depicted are flexible jumpers 36*a*, 36*b*, 36*c*, 36*d*, 36*e*, and 36*f*.

Figure 3:
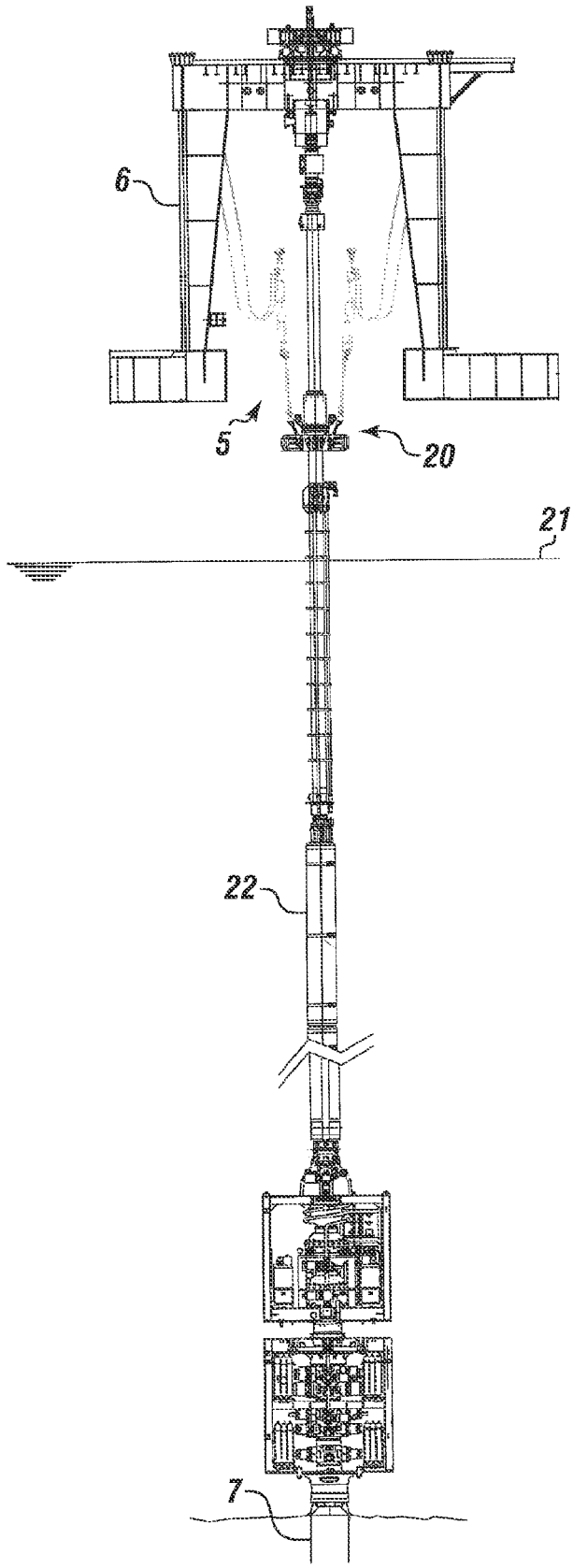
FIG. 3 depicts an overall view of a drilling rig connected to the tensioner system and a subsea well.

FIG. 3 depicts an overall view of an offshore drilling rig 6 connected to the tensioner system 5. The tensioner system 5 can be connected to a tension ring 20 on a drilling riser 22, which can connect to a subsea well 7. Also depicted is a water line 21, above which is located the tension ring 20 and the tensioner system 5.

While these embodiments have been described with emphasis on the embodiments, it should be understood that within the scope of the appended claims, the embodiments might be practiced other than as specifically described herein.

What is claimed is:

1. A tensioner system with independently operable recoil controls for an offshore drilling rig for drilling wells, the tensioner system comprising a plurality of removable independently operable riser tensioner assemblies, wherein each removable independently operable riser tensioner assembly comprises:

a. an independently operable fluid containment storage comprising a goose neck for connecting to a flexible jumper, wherein the independently operable fluid containment storage is disposed on an independently operable hydraulic cylinder that powers a rod, wherein the rod engages a clevis, wherein the independently operable hydraulic cylinder engages a blind end clevis opposite the clevis, wherein the clevis engages a tension ring on a drilling riser, and wherein the independently operable fluid containment storage is connected directly to and attached directly to the independently operable hydraulic cylinder;

b. an integrated independently operable bidirectional riser recoil valve in direct fluid communication between the independently operable hydraulic cylinder and the independently operable fluid containment storage, wherein the integrated independently operable bidirectional riser recoil valve is connected directly to the independently operable fluid containment storage and is connected to the independently operable hydraulic cylinder; and c. an integrated independently operable recoil controller connected to and in communication with the integrated independently operable bidirectional riser recoil valve for regulating flow of the hydraulic fluid through the integrated independently operable bidirectional riser recoil valve to control a disconnect process of the drilling riser supported by the offshore drilling rig by controlled raising or lowering of the drilling riser, and wherein the integrated independently operable recoil controller is disposed at a location on the independently operable fluid containment storage or the independently operable hydraulic cylinder.

2. The tensioner system of claim 1, wherein the independently operable hydraulic cylinder and the independently operable fluid containment storage are connected and attached using a plurality of saddles.

3. The tensioner system of claim 1, wherein the rod further comprises a rod end seal head for flowing the hydraulic fluid bidirectionally through the integrated independently operable bidirectional riser recoil valve.

4. The tensioner system of claim 1, wherein the wells are natural gas wells, oil wells, or water wells.

5. The tensioner system of claim 1, wherein the integrated independently operable bidirectional riser recoil valve is connected to the independently operable hydraulic cylinder with piping.

6. The tensioner system of claim 1, wherein the integrated independently operable bidirectional riser recoil valve is connected directly to the independently operable fluid containment storage by: bolting, welding, threading, another mechanical connection, or combinations thereof.

7. A tensioner system with independently operable recoil controls for an offshore drilling rig for drilling wells, the tensioner system comprising a plurality of removable independently operable riser tensioner assemblies, wherein each removable independently operable riser tensioner assembly comprises:

a. an integrated independently operable bidirectional riser recoil valve;

b. an independently operable hydraulic cylinder in direct fluid communication with and connected to the integrated independently operable bidirectional riser recoil valve, wherein the independently operable hydraulic cylinder powers a rod, wherein the rod engages a clevis, wherein the independently operable hydraulic cylinder engages a blind end clevis opposite the clevis, and wherein the clevis engages a tension ring on a drilling riser;

c. an independently operable fluid containment storage in direct fluid communication with the integrated independently operable bidirectional riser recoil valve opposite the independently operable hydraulic cylinder, wherein the integrated independently operable bidirectional riser recoil valve is connected directly to the independently operable fluid containment storage, wherein the independently operable fluid containment storage comprises a goose neck connected to a flexible jumper, and wherein the independently operable hydraulic cylinder is connected directly to and attached directly to the independently operable fluid containment storage; and d. an integrated independently operable recoil controller connected to and in communication with the integrated independently operable bidirectional riser recoil valve for regulating flow of the hydraulic fluid through the integrated independently operable bidirectional riser recoil valve to control a disconnect process of the drilling riser by controlled raising or lowering of the drilling riser, wherein the integrated independently operable recoil controller is disposed at a location on the independently operable fluid containment storage or the independently operable hydraulic cylinder.

8. The tensioner system of claim 7, wherein the independently operable hydraulic cylinder and the independently operable fluid containment storage are connected and attached using a plurality of saddles.

9. The tensioner system of claim 7, wherein the rod further comprises a rod end seal head for flowing the hydraulic fluid bidirectionally through the integrated independently operable bidirectional riser recoil valve.

10. The tensioner system of claim 7, wherein the integrated independently operable bidirectional riser recoil valve is in direct fluid communication with the independently operable hydraulic cylinder through piping.

11. The tensioner system of claim 7, wherein the integrated independently operable bidirectional riser recoil valve is connected directly to the independently operable fluid containment storage by: bolting, welding, threading, another mechanical connection, or combinations thereof.

12. A direct acting riser tensioner system comprising a plurality of riser tensioner assemblies, wherein each riser tensioner assembly comprises:

a. an accumulator disposed on a hydraulic cylinder, wherein the accumulator and the hydraulic cylinder are each independently operable, wherein the hydraulic cylinder is connected directly to and attached directly to the accumulator;

b. a bidirectional riser recoil valve connected directly to the accumulator, connected to the hydraulic cylinder, and in direct fluid communication with the accumulator and the hydraulic cylinder, wherein the bidirectional riser recoil valve is configured to regulate a flow of the hydraulic fluid between the accumulator and the hydraulic cylinder, wherein the bidirectional riser recoil valve is integrated with the accumulator and the hydraulic cylinder, wherein the bidirectional riser recoil valve is independently operable, and wherein the hydraulic cylinder is configured to engage a tension ring on a drilling riser for applying a tension to the drilling riser; and c. a controller connected to and in communication with the bidirectional riser recoil valve, wherein the controller is configured to control the flow of the hydraulic fluid through the bidirectional riser recoil valve, wherein the controller is integrated with the accumulator, the hydraulic cylinder, and the bidirectional riser recoil valve, and wherein the controller is disposed at a location on the accumulator or the hydraulic cylinder.

13. The direct acting riser tensioner system of claim 12, wherein the accumulator is in fluid communication with a jumper.

14. The direct acting riser tensioner system of claim 12, wherein the bidirectional riser recoil valve is connected between the accumulator and the hydraulic cylinder.

15. The direct acting riser tensioner system of claim 12, wherein the bidirectional riser recoil valve is in direct fluid communication with the hydraulic cylinder through piping.

16. The direct acting riser tensioner system of claim 12, wherein the hydraulic cylinder and the accumulator are connected and attached using at least one saddle.

17. The direct acting riser tensioner system of claim 12, wherein the bidirectional riser recoil valve is directly connected to the accumulator by: bolting, welding, threading, another mechanical connection, or combinations thereof.

* * * * *